US005302147A

United States Patent [19]

Oishi

[11] Patent Number: 5,302,147

[45] Date of Patent: Apr. 12, 1994

[54] COWLING ASSEMBLY FOR A MARINE PROPULSION ENGINE

[75] Inventor: Hiroshi Oishi, Hamamatsu, Japan

[73] Assignee: Sanshin Industries, Co., Ltd.

[21] Appl. No.: 949,132

[22] Filed: Sep. 23, 1992

[30] Foreign Application Priority Data

Sep. 27, 1991 [JP] Japan ..... 3-276514

[51] Int. Cl.[5] ..... B63H 21/36

[52] U.S. Cl. ..... 440/77

[58] Field of Search ..... 440/77, 900, 76, 78

[56] References Cited

U.S. PATENT DOCUMENTS

| | | | |
|---|---|---|---|
| 2,224,900 | 12/1940 | Conover | 440/77 |
| 3,955,526 | 5/1976 | Kusch | 440/77 |
| 4,571,193 | 2/1986 | Takada et al. | 440/77 |
| 4,869,693 | 9/1989 | Curtis et al. . | |
| 5,052,961 | 10/1991 | Uchida et al. | 440/77 |
| 5,064,393 | 11/1991 | Inoue | 440/77 |

FOREIGN PATENT DOCUMENTS 2-151594 6/1990 Japan .

*Primary Examiner*—Michael S. Huppert
*Assistant Examiner*—Thomas J. Brahan
*Attorney, Agent, or Firm*—Bacon & Thomas

[57] ABSTRACT

A unitary cowling assembly for covering a fore-to-aft extending marine propulsion engine comprising a front cowling section adapted to extend around a front portion of the marine propulsion engine and a rear cowling section adapted to be fixedly connected to the front cowling section and to extend around a rear portion of the marine propulsion engine is disclosed. By extending the front and rear cowling sections fore and aft of the engine and interconnecting the cowling sections along a stiffened joint that extends laterally across the engine, the top surface and the side surfaces of the cowling, which are subjected to the highest vibrational loads from operation of the marine engine, can be structurally reinforced so as to inhibit such vibrations and the associated noise, while still providing an easily moldable cowling assembly.

7 Claims, 2 Drawing Sheets

COWLING ASSEMBLY FOR A MARINE PROPULSION ENGINE

BACKGROUND OF THE INVENTION

1. Field of the Invention

The present invention pertains to a cowling assembly for a marine propulsion engine and, more specifically, to a cowling assembly formed from two or more fore-to-aft extending sections which are fixedly connected to form a unitary cowling member.

2. Description of the Prior Art

It is widely known in the marine art to cover a propulsion engine with a cowling. Since such cowlings often need to be manually removed to gain access to the engines, it is desirable to minimize the weight of the cowling. To achieve this minimal weighing, it has been proposed to mold such cowlings from plastic or other lightweight materials. In order for the cowling to have sufficient strength and in order to avoid noise problems associated with vibrations developed during running of the marine engine, prior art cowlings have been made relatively thick which undesirably increases the weight of the cowling.

As exemplified by U.S. Pat. No. 4,869,693, it has heretobefore been proposed to form an upper cowling member from two parts which are divided in the lengthwise direction so as to form right and left halves which are permanently joined together. Constructing the cowling from two halves takes advantage of known mold manufacturing processes resulting in reduced costs. Unfortunately, although such a cowling formed from left and right halves which are joined together increases the strength of the top of the cowling, the left and right sides remain low in strength.

Due to the inherent vibrations developed during operation of a marine engine, the left and right sides of the cowling, as well as the top, are subject to the greatest vibrational fatigue stress and strains. Therefore, although the prior art teaches providing a cowling formed from two parts which are secured together in the lengthwise direction so as to increase the strength of the top of the cowling, such prior art does not provide for increasing the strength of the left and right sides of the cowling and therefore there is a need in the art for a cowling assembly which can inhibit vibrations on not only the top of the cowling but also the left and right sides as well.

SUMMARY OF THE INVENTION

It is the object of the present invention to provide a cowling assembly for covering a fore and aft extending marine propulsion engine which provides for increased strength of the cowling top as well as both the left and right sides so as to inhibit vibrations of the cowling during operation of the engine.

It is a further object of the present invention to provide a structurally sound, yet lightweight cowling assembly for covering a marine propulsion engine which can be readily manufactured by known molding processes.

These and other objects of the present invention are accomplished by providing a unitary cowling assembly for covering a fore and aft extending marine propulsion engine wherein the cowling assembly comprises a front cowling section adapted to extend around a front portion of a marine propulsion engine and a rear cowling section adapted to extend around a rear portion of the marine propulsion engine. The front and rear sections of a cowling assembly constructed in this manner are joined from a left surface portion, across a top portion and along a right surface portion such that the strength of the top, left and right sides of the cowling is increased, thereby inhibiting vibrations on these surfaces and reducing noise that would result from their vibration.

Additional objects, features and advantages of the present invention will become more readily apparent from the following detailed description of preferred embodiments thereof, when taken in conjunction with the drawings wherein like reference numerals refer to corresponding parts in the several views.

DETAILED DESCRIPTION OF THE PREFERRED EMBODIMENTS

Figure 1:
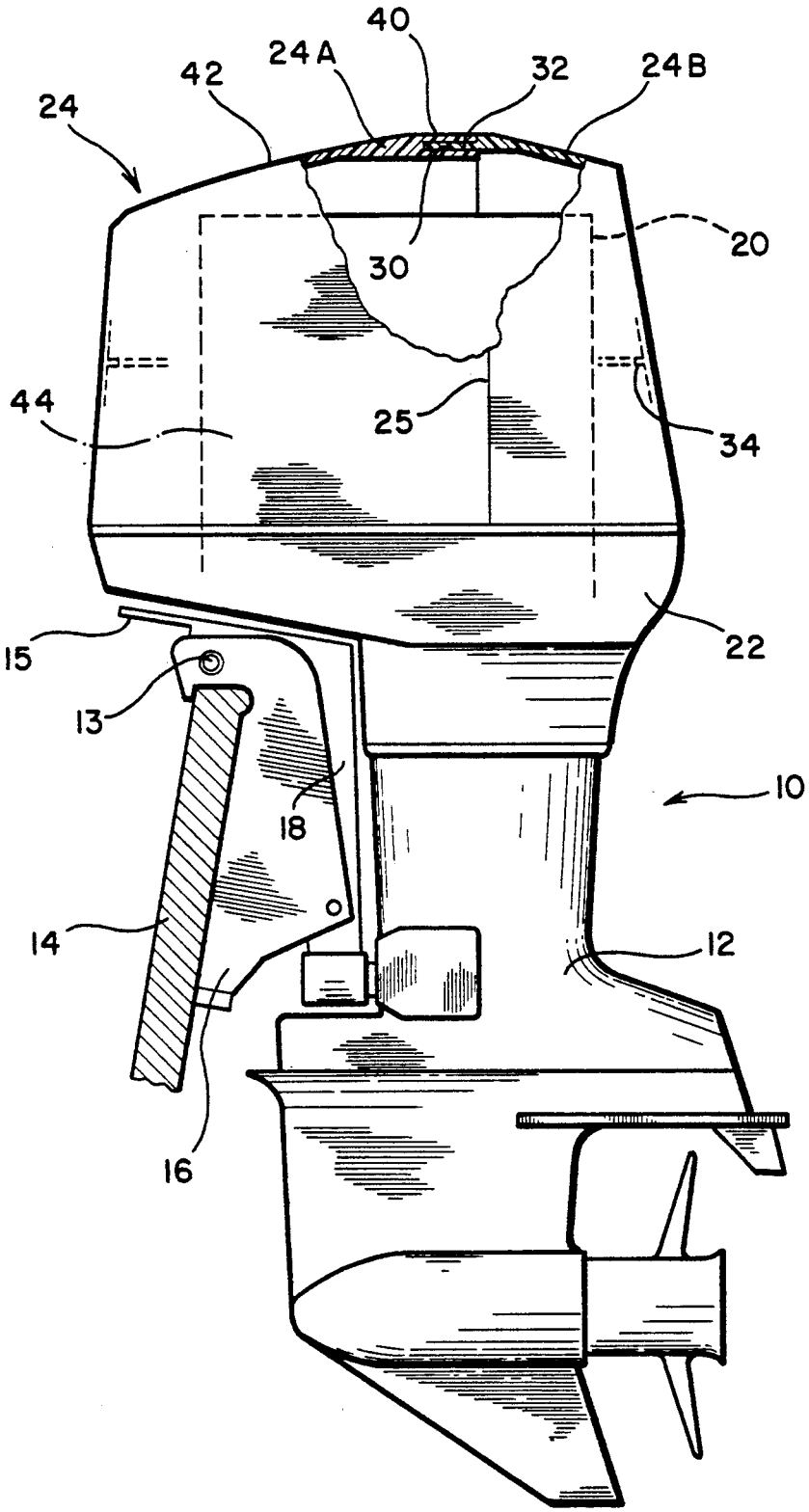
FIG. 1 depicts a side view of an outboard marine engine equipped with the cowling assembly of the present invention.

With initial reference to FIG. 1, an outboard marine engine is generally indicated at 10 and includes a propulsion unit 12 which is pivotally mounted about a tilt pin 13 to a stern plate or transom 14 of a watercraft. Propulsion unit 12 can also be steered by means of a steering bracket 15. Tilt pin 13 is formed as part of a clamp bracket 16 and steering bracket 15 is formed part of a swivel bracket 18 which functions to pivotally and steerably attach propulsion unit 12 to transom 14 in a manner known in the art. As also known in the art, propulsion unit 12 is driven by an engine 20 secured thereabove. Engine 20 is adapted to be covered by a cowling assembly as will be described in detail below with initial reference to FIGS. 1 and 2.

Figure 2:
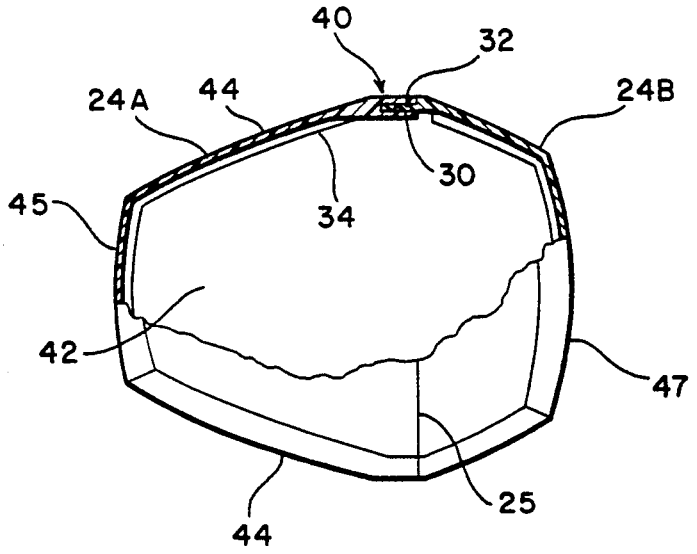
FIG. 2 is a top, partial cross-sectional view of the cowling assembly of FIG. 1.
Figure 3:
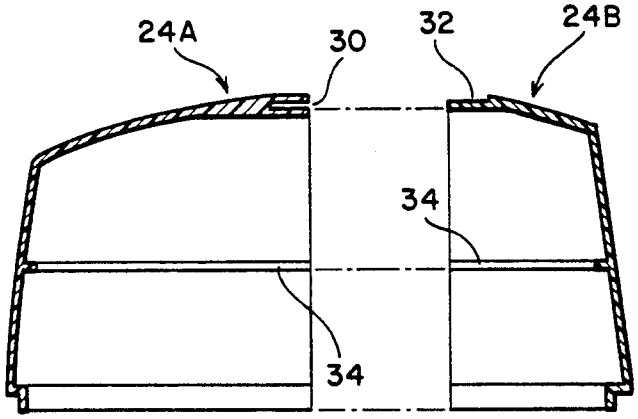
FIG. 3 is an exploded cross-sectional side view of a portion of the cowling assembly shown in FIG. 1.

As depicted, the cowling assembly includes an upper cowling member 24 which is comprised of a front cowling section 24A and a rear cowling section 24B. Front cowling section 24A extends around a front portion of marine propulsion engine 20 and rear cowling section 24B extends around a rear portion of marine propulsion engine 20. Front and rear cowling sections 24A, 24B are adapted to be fixedly secured together to form a unitary upper cowling member 24. According to the preferred embodiment, front and rear cowling sections 24A, 24B are joined by bifurcating the rear end (not labeled) of front cowling section 24A so as to form a groove 30. The front end (not labeled) of rear cowling section 24B is provided with a tongue 32 which is adapted to project into groove 30 and to be adhesively bonded therein as depicted in FIGS. 1 and 2. By using an adhesive, front cowling section 24A and rear cowling section 24B can be fixedly secured together about a joint line indicated at 25.

By this arrangement, the junction between front cowling section 24A and rear cowling section 24B, generally indicated at 40, increases the thickness and thereby the resistance to deflection of unitary cowling member 24 along the joint as compared with the adjacent top sidewall 42 as well as left and right sidewalls 44. Therefore, the strength of the top and the left and right sidewalls 42,44 of unitary cowling member 24 is increased where needed in order to minimize vibrations on the these surfaces and reduce the noise resulting from operational vibration. Obviously, this junction area 40 is thicker and heavier than a cowling with no such junction and is actually shorter in length than the junction associated with the prior art as discussed above which extends lengthwise on the cowling. This shorter junction length also functions to prevent an unnecessary weight increase of upper cowling member 24 so as to permit upper cowling member 24 to be readily, manually removed from lower cowling member 22 when desired. This shorter junction length also decreases the amount of adhesive necessary to join the two cowling sections 24A and 24B.

Further in accordance with the present invention, a horizontally extending rib 34 is provided on the inside of upper cowling member 24, generally intermediate the point between top sidewall 42 and the connection of upper cowling member 24 with lower cowling member 22. Ribs 34 functions to increase the wall thickness in a predetermined portion of the upper cowling member 24 so as to further improve the strength of the left and right sidewalls 44 as well as front wall 45 and rear wall 47. In practice, it has been found that ribs 34 provide sufficient increased strength to front and rear walls 45 and 47 since these surfaces have less area and are not as prone to the inherent vibrations developed during operation of engine 20. Depending upon the size of engine 20, a larger cowling may be required and it is possible to increase the size and/or number of ribs 34 accordingly.

Figure 4:
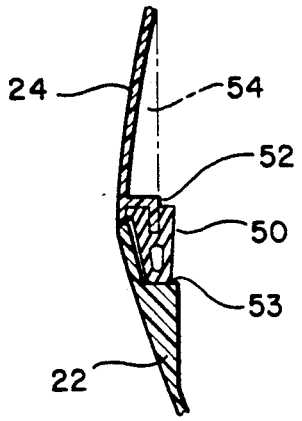
FIG. 4 is an enlarged cross-sectional side view of an attachment area between upper and lower cowling units.

Reference will now be made to FIG. 4 in showing the attachment between upper cowling member 24 and lower cowling member 22 through the use of a rubber seal 50. Upper cowling member 24 is integrally formed with a stepped ring 52 extending from an inside surface thereof. Seal 50 is adapted to be attached to stepped ring 52 and to engage a flat 53 formed as part of rear cowling member 22. At this point, it should be noted that since upper cowling member 24 is molded of two or more front-to-rear extending pieces, the front and rear sections 24A and 24B of upper cowling member 24 can be removed from a mold in a horizontal direction. This provides an advantage over the prior art arrangement discussed above wherein, since the longitudinally divided cowling was typically removed from the mold vertically, a thickened portion 54 was required to enable the molded cowling to be removed from the mold. In accordance with the present invention, the thickened portion is not required, since the molded cowling can be removed horizontally from the mold. This further reduces the weight of the cowling section and reduces the amount of molding material required to form the cowling. Again, this minimizes the weight of upper cowling member 24 so as to ease the installation and removal of upper cowling member 24 from lower cowling member 22. Furthermore, since the front and rear cowling sections 24A and 24B can be horizontally removed from a mold, ribs 34 can be formed around the inside circumference of upper cowling member 24 in a relatively simple manner.

Figure 5:
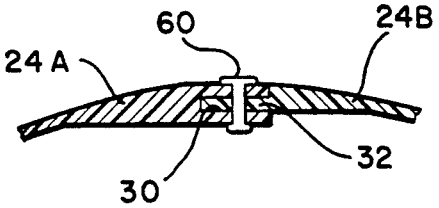
FIG. 5 is a partial cross-sectional view depicting the connection between the front and rear cowling sections of the present invention according to a second embodiment thereof.

In the above-described embodiment, an adhesive was used to fix tongue 32 of rear cowling section 24B in groove 30 of front cowling section 24A. The embodiment depicted in FIG. 5 is presented to show that various other fastener means in the art, such as rivet 60 for example, could also be used to secure front and rear cowling sections 24A, 24B together.

Although described with respect to preferred embodiments of the invention, it should be readily understood that various changes and/or modifications can be made to the present invention without departing from the spirit thereof. For instance, although the invention was described with respect to upper cowling member 24 being split into two pieces, it would also be possible to form upper cowling member 24 from three or more pieces, each of which extend fore and aft with respect to engine 20. It is also possible to form lower cowling member 22 in a similar manner to that described with respect to upper cowling member 24. Furthermore, the tongue and groove type of attachment between front cowling section 24A and rear cowling section 24B is cited as only exemplary and various other attachment arrangements could readily be utilized without departing from the spirit or scope of the invention. Finally, the junction line 25 between front cowling section 24A and rear cowling section 24B need not be perpendicular to top wall 42 or sidewalls 44 but could be provided at an angle so as to increase the surface area thereof. In general, the invention is only intended to be limited by the scope of the following claims.

I claim:

1. A cowling assembly for covering a fore-to-aft extending marine propulsion engine comprising:

a front cowling section having a front wall, a top wall and sidewalls adapted to extend around a front portion of a marine propulsion engine;

a rear cowling section having a rear wall, a top wall and a sidewalls adapted to extend around a rear portion of a marine propulsion engine; and means for permanently, fixedly connecting said front and rear cowling sections along a continuous joint extending laterally across the top wall and sidewalls thereof to form a unitary cowling member, said joint having an associated thickness which is greater than the adjacent thickness of the top walls and sidewalls of the front and rear cowling sections such that said cowling assembly is stiffer in resisting deflection at the top wall and sidewalls which are subject to the greatest stresses and strains created by vibrations developed during operation of a marine propulsion engine.

2. A cowling assembly is claimed in claim 1, wherein said connecting means comprises an adhesive.

3. A cowling assembly as claimed in claim 1, wherein said connecting means comprises a fastener.

4. A cowling assembly as claimed in claim 1, wherein said unitary cowling member comprises an upper cowling member, composed of said front and rear cowling sections, which is adapted to be removably secured to a lower cowling member of said cowling assembly.

5. A cowling assembly as claimed in claim 1, wherein each of said front and rear cowling sections are provided with at least one internal reinforcement rib.

6. A cowling assembly as claimed in claim 4, wherein the at least one internal reinforcement rib on each of said front and rear cowling sections extends generally horizontally and is located on said sidewalls, spaced from said top walls thereof.

7. A cowling assembly as claimed in claim 1, wherein one of said front and rear cowling sections terminates at said joint in a bifurcated portion and the other of said cowling sections terminates at said joint in the form of a tongue, said tongue extending into said bifurcated section to form said joint.

* * * * *